US008490781B2

(12) United States Patent
Meschenmoser et al.

(10) Patent No.: US 8,490,781 B2
(45) Date of Patent: Jul. 23, 2013

(54) TRANSPORT CONTAINER SYSTEM FOR PRESCRIPTION SPECTACLE LENS PRODUCTION AND METHOD FOR TRANSPORTING SPECTACLE LENSES AND/OR SPECTACLE LENS BLANKS

(75) Inventors: Ralf Meschenmoser, Dewangen (DE); Wolfgang Widmann, Aalen (DE)

(73) Assignee: Carl Zeiss Vision GmbH, Aalen (DE)

( * ) Notice: Subject to any disclaimer, the term of this patent is extended or adjusted under 35 U.S.C. 154(b) by 0 days.

(21) Appl. No.: 13/045,241

(22) Filed: Mar. 10, 2011

(65) Prior Publication Data

US 2011/0220519 A1 Sep. 15, 2011

Related U.S. Application Data

(63) Continuation of application No. PCT/EP2009/006036, filed on Aug. 20, 2009.

(30) Foreign Application Priority Data

Sep. 10, 2008 (DE) ..... 10 2008 041 945

(51) Int. Cl.
*A45C 11/04* (2006.01)
*B65D 6/04* (2006.01)

(52) U.S. Cl.
USPC ..... 206/5; 206/558; 206/564; 220/23.88

(58) Field of Classification Search
USPC ..... 206/5, 5.1, 6, 509, 511, 564, 454, 206/558; 53/443, 447; 220/23.83, 23.87, 220/23.88; 351/158; 414/788.1
See application file for complete search history.

(56) References Cited

U.S. PATENT DOCUMENTS 3,124,240 A * 3/1964 Croan ..... 206/5
3,351,192 A 11/1967 La Plante
4,976,351 A * 12/1990 Mangini et al. ..... 206/564
5,046,609 A * 9/1991 Mangini et al. ..... 206/232
5,366,069 A * 11/1994 Seidner ..... 220/23.83
5,979,643 A * 11/1999 Blonder et al. ..... 206/564

(Continued)

FOREIGN PATENT DOCUMENTS

DE 41 27 094 A1 2/1993
NL 8700276 A 9/1988

OTHER PUBLICATIONS

English translation of German Patent Office action of Jun. 2, 2009 issued in the corresponding German patent application 10 2008 041 945.1.

(Continued)

*Primary Examiner* — Luan K Bui
(74) *Attorney, Agent, or Firm* — Walter Ottesen P.A.

(57) ABSTRACT

A transport container system for spectacle lenses includes a base container having first and second insert receptacles. A first pair of identical inserts for the first and second insert receptacles are provided and each insert has a spectacle lens receptacle for receiving a spectacle lens in a positionally oriented manner. The inserts are insertable into the first and second insert receptacles so that the geometrical centers of the spectacle lenses are arranged at a first distance from one another. A second pair of identical inserts differing from the first pair is provided for the first and second insert receptacles. The inserts each have a spectacle lens receptacle for receiving a spectacle lens in a positionally oriented manner and are insertable into the first and second insert receptacles so that the geometrical centers of the spectacle lenses received therein are arranged at a second distance different from the first distance.

19 Claims, 10 Drawing Sheets

U.S. PATENT DOCUMENTS

| | | | | |
|---|---|---|---|---|
| 6,159,072 | A | 12/2000 | Shibata | |
| 6,612,454 | B1 * | 9/2003 | Lin | 220/23.88 |
| 6,860,390 | B2 * | 3/2005 | Bowman | 206/534 |
| 6,974,293 | B2 | 12/2005 | Stokes | |
| 6,974,298 | B2 | 12/2005 | Tanaka | |

OTHER PUBLICATIONS

English translation of the Written Opinion of the International Searching Authority of Mar. 24, 2011 issued in the corresponding international application PCT/EP 2009/006036.

International Search Report for PCT/EP 2009/006036 on which the claim of priority for this application is based.

Brochure of Carl Zeiss Vision entitled "Erfindermeldung: Universeller Transportbehaelter fuer komplette Rezept-Brillenglasfertigung" dated Apr. 2, 2008.

Notification to Grant Patent Right for Invention of the Chinese Patent Office dated Sep. 5, 2012 in the corresponding Chinese patent application 200980135253.7 and English translation thereof.

* cited by examiner to FIG. 10A

TRANSPORT CONTAINER SYSTEM FOR PRESCRIPTION SPECTACLE LENS PRODUCTION AND METHOD FOR TRANSPORTING SPECTACLE LENSES AND/OR SPECTACLE LENS BLANKS

CROSS REFERENCE TO RELATED APPLICATIONS

This application is a continuation application of international patent application PCT/EP 2009/006036, filed Aug. 20, 2009, designating the United States and claiming priority from German application 10 2008 041 945.1, filed Sep. 10, 2008, and the entire content of both applications is incorporated herein by reference.

FIELD OF THE INVENTION

The invention relates to a transport container system for spectacle lenses and/or spectacle lens blanks in prescription spectacle lens production.

BACKGROUND OF THE INVENTION

In the spectacle industry, at present the blanks or semifinished products through to the finished spectacles with frames are transported or kept in different transport containers during the various stages of adding value.

So there are special containers in which the semifinished products or blanks, for example made of silicate glass or plastic, are exclusively transported during what is known as base lens production, that is to say until the spectacle lenses have been given the appropriate prescribed optical properties. The containers have receptacles for a pair of spectacle blanks intended for a pair of spectacles. Receptacles are arranged with a dimension between axes of 130 mm. This means that the geometrical centers of the spectacle lenses or spectacle lens blanks of a pair of spectacle lenses or spectacle lens blanks that are received by the receptacles are at a distance of 130 mm. This dimension between axes results from the fact that the distances between grippers and spindles on the base lens machining tool (milling, centering, turning, polishing process) has been standardized by the major manufacturers to a uniform dimension of 130 mm. The containers for the base lens production are often used not only for receiving the semifinished or unfinished products but also for receiving polishing tools and the prescription. One such container was developed at the beginning of the 90s by Carl Zeiss in collaboration with a partner.

At the request of the customer, spectacles are also tinted. In particular, a photochromic coating can also be applied. Because the containers used for transporting the base lenses are generally contaminated as a result of the foregoing machining of the spectacle lens blanks, it is customary to provide a further container for the unfinished lenses cleaned after the base lens machining and to pass the pairs of lenses on to the tinting process while arranged in this container.

The possibly tinted base lenses are then generally subjected to further finishing steps. For example, a hard coating may be carried out to make the lenses more scratch-resistant. For this process, the base lenses are inserted into holders, where they are only supported at the rim, without there being any contact with one of the optically active surfaces. According to the company's internal state of the art, these holders receiving the lenses are transported in special plastic containers. After the hard coating, usually an antireflection coating and possibly also an antiadhesion coating are applied, to prevent the adherence of dirt particles. After that, the finished products are passed on to quality control. For transporting the lenses together with the prescription, once again containers that have been specifically developed, for example by the applicant, are provided. The receptacles both for the inserts and for the spectacle lenses are arranged with a dimension between axes of 112.5 mm. This different dimension between axes is required because the standard dimension between axes in control and packaging installations does not correspond to the base lens machining tools, but is 112.5 mm.

In truing workshops, again different containers are used to transport the finished products, the spectacle frame, any formers and the associated prescription. The containers used by many optometrists as well as by the applicant itself have dish-shaped compartments instead of generally customary steps as a depository for the lenses. These dish-shaped receptacles for a pair of finished spectacle lenses intended for a pair of spectacles are a component part of the assigned inserts, which in turn have themselves been inserted into corresponding receptacles in the container. The receptacles both for the inserts and for the spectacle lenses are arranged with a dimension between axes of 130 mm. This standardized dimension between axes is based on the standard for grippers and spindle arrangements of the major manufacturers of such installations.

Although the aforementioned transport containers have proven to be satisfactory in principle, there is the need for a uniform container concept and a correspondingly adapted process sequence.

SUMMARY OF THE INVENTION

This object is achieved by a transport container system for spectacle lenses and/or spectacle lens blanks in prescription spectacle lens production and by a method for transporting spectacle lenses and/or spectacle lens blanks in prescription spectacle lens production.

The transport container system according to the invention for spectacle lenses and/or spectacle lens blanks comprises a container referred to hereafter as the base container for a pair of spectacle lenses or spectacle lens blanks. This base container has two receptacles, which are referred to hereafter as the first and second insert receptacles and are in each case formed or designed for receiving a first or second insert in a positionally oriented manner. The two inserts are formed substantially identically. They have in each case a spectacle lens receptacle, which serves in each case for receiving a spectacle lens or a spectacle lens blank, or are correspondingly formed or designed. The spectacle lens receptacles of the two inserts are formed and designed in such a way that they can receive a spectacle lens or a spectacle lens blank in a predetermined positional orientation. As a result of their geometry being formed to complement the respective receptacles of the base container, the two inserts can be inserted into the first or second insert receptacle in such a way that the geometrical centers of the spectacle lenses or spectacle lens blanks received as intended by the first pair of identical inserts are arranged at a first predetermined distance from one another.

According to the invention, a component part of the transport container system is a second pair of substantially identical inserts for the first or second insert receptacle that differs from the first pair. These inserts also have in each case a spectacle lens receptacle for receiving a spectacle lens or a spectacle lens blank in a positionally oriented manner. The shape of the inserts in the decisive region is chosen to complement the two insert receptacles in such a way that it can be inserted into the first or second insert receptacle in such a way that the geometrical centers of the spectacle lenses or spectacle lens blanks received as intended by the second pair of identical inserts are arranged at a first distance or second distance, differing from the first distance, from one another. In other words, the dimension between axes of spectacle lenses or spectacle lens blanks inserted as intended into the corresponding receptacles of the inserts of the second pair of inserts is either identical or, in the currently usually preferred case, different from the dimension between axes of the spectacle lenses or spectacle lens blanks inserted as intended into the corresponding receptacles of the inserts of the first pair of inserts.

Instead of two insert receptacles, the transport container system may also be provided with a third insert receptacle for receiving the second insert in a positionally oriented manner, the geometrical centers of the first and third insert receptacles being arranged at a distance from one another differing from the distance between the geometrical centers of the first and second insert receptacles. The first pair of inserts, comprising the first and second inserts, can be inserted optionally into the first two insert receptacles or into the first and third insert receptacles, so that the dimension between axes of spectacle lenses or spectacle lens blanks inserted as intended into the corresponding receptacles of the inserts of the pair of inserts in the second case (first and third insert receptacles) is different from the dimension between axes of the spectacle lenses or spectacle lens blanks inserted as intended into the corresponding receptacles of the inserts of the pair of inserts in the first case (first and second insert receptacles).

If the transport container system comprises three insert receptacles, a second pair of identical inserts may be provided for the first and second insert receptacles, the inserts having in each case a spectacle lens receptacle for receiving a spectacle lens or a spectacle lens blank in a positionally oriented manner and being insertable into the first and second insert receptacles in such a way that the geometrical centers of the spectacle lenses or spectacle lens blanks received as intended by the second pair of identical inserts are arranged at a distance from one another differing from the distance of the geometrical centers of the spectacle lenses or spectacle lens blanks received as intended by the first pair of identical inserts inserted into the first and second insert receptacles. Different pairs of inserts are required whenever it is wished to ensure that the state of production of a blank is identifiable on the basis of the insert used. If, for example, a one-off reject spectacle lens is returned to an earlier process step for reworking or individual refabrication, the transport container can be loaded with different inserts. In this way, each spectacle lens has the suitable insert for its state of production.

The insert receptacles and the inserts of the first pair or the second pair of the transport container system according to the invention that is described above may be formed such that they complement one another in such a way that the inserts inserted into the insert receptacles have a predetermined orientation in relation to one another. The arrangement of the insert receptacles in the base container with predetermined orientation allows removal of the spectacle lenses or blanks from the base container in a known alignment and accordingly also positionally oriented insertion in a workpiece receptacle of a machining tool or a measuring device. If the machining or measuring of the blank or the lens is position- and/or direction-dependent, in the most favorable case there is no need for prior determination of the position and direction in relation to the tool or—if the precision of the machining or measuring so requires—any readjustment that may be required can be minimized.

The inserts of the first pair may be formed for receiving semifinished spectacle lenses. This is required for example whenever—as described below under section B-D—a transport of spectacle lens blanks/spectacle lenses is intended to be carried out with the transport container system during the production of the spectacle lenses from semifinished products. The semifinished spectacle lens receptacles of the inserts for semifinished products are specifically designed such that the respective semifinished product HF lies flat on its lower cylindrical rim and that semifinished products with a diameter of, for example, 65 mm are securely fixed and that semifinished products with a diameter of, for example, 85 mm can still be centered.

The inserts of the first or second pair may be optionally formed also for receiving spectacle lenses during their finishing. Finishing of spectacle lenses is understood as meaning the processes of tinting, in which the lenses are given a tint generally requested by the customer, hard coating, in which the mechanically finished and possibly tinted spectacle lenses are provided with a protective coating that prevents or reduces scratching of the surface, and antireflection coating, in which the spectacle lenses with or without a hard coating are provided with a reflection-reducing antireflection coating. In some cases, hydrophobic top coatings are also applied. The inserts for the finishing make it possible by their adapted shaping for round, oval and freely formed lenses to be supported without being damaged and/or for packed individual lenses (for example specimens) to be taken along at the same time. They have, for example, gripper openings for lifting out spectacle lenses. They may have a connecting member for a 3- and/or 4-finger gripper. They may, for example, be formed suitably for lenses with adhesively bonded disposable holders. It has been found to be advantageous if the inserts have a bottom marking for aligning the spectacle lenses on the basis of their permanent signatures. The inserts may be formed in a light color, in particular in white, so that contaminants can be detected comparatively easily.

Furthermore, a third pair of identical inserts may be provided for the first insert receptacle and for the second or third insert receptacle, formed for receiving the spectacle lenses during truing. The terms "first", "second" and "third" should not be understood in the present description in the sense of a sequence, but merely serve instead for allowing differentiation between the insert receptacles referred to by them. Insert receptacles for receiving the spectacle lenses during truing serve as a means of fixing unblocked spectacle lenses. Furthermore, they are also intended to serve for fixing blocked spectacle lenses before truing, for all commonly used block pieces.

It has been found that it is favorable if the transport container system comprises not only a base container, or possibly a number of base containers that can be connected to one another (possibly releasably), of the type described above but also a first adapter container (or a number of identical "first" adapter containers) that can be releasably connected to the base container. Such an adapter container makes it possible to receive the spectacle lenses of the pair of assignable components.

For example, the first adapter container may have a receptacle for receiving a spectacle frame. This is required in particular whenever transport to and/or during the "truing of the spectacle lenses" is intended. The receptacle of the adapter container may have, for example, a detent, in order to fix the spectacle frame captively in the adapter container. The adapter container may serve, and be formed, not only for receiving a spectacle frame but also for receiving screws and nose pads and a (spectacle) case.

The distance from the generally somewhat higher adapter container is bridged by supporting elements on the base container, in order to provide stackability.

The transport container system may also comprise a second adapter container (or a number of once again identical second adapter containers) that can be releasably connected to the first adapter container and/or the base container. This is required whenever not only the items located in the base container and in the first adapter container but also further items assigned or assignable to the pair of spectacle lenses have to be taken along at the same time together with the spectacle lenses during transport. This means, for example, that, during the truing, the base container may be loaded either with an additional adapter container or with a second adapter container on the first adapter container if the frame and the case take up too great a volume.

This second adapter container may, for example, have a special receptacle for receiving a spectacle case. The receptacle for receiving the spectacle case is provided, for example, with a latching device, in order to hold the case captively. A spectacle case may, for example, be taken along at the same time in order to receive the finished spectacle lenses after truing. The lens located in the spectacle case can then be packed and sent to the customer.

The transport container system may also comprise a third adapter container (or a number of identical third adapter containers) that can be releasably connected to the first adapter container and/or the second adapter container and/or the base container for one or more items required for the production of the spectacles. For instance, the third adapter container may have a receptacle for receiving one or more polishing tools.

It may be advantageous if the base container and/or the first adapter container and/or the second adapter container and/or the third adapter container are formed such that, though geometrically identical (to a great extent), they can be differentiated from one another. An identical geometry may be favorable to allow a number of containers of the type specified above to be releasably connected to one another or stacked.

The method according to the invention for transporting spectacle lenses and/or spectacle lens blanks by means of a transport container system, in particular of a type described above, during production comprises the following method steps: firstly, a base container with a first insert receptacle for receiving in a positionally oriented manner a first insert for receiving a spectacle lens or a spectacle lens blank and with a second insert receptacle for receiving in a positionally oriented manner a second insert for receiving a spectacle lens or a spectacle lens blank is provided. The base container is then loaded with a first pair of identical inserts for the first and second insert receptacles, the inserts having in each case a spectacle lens receptacle for receiving a spectacle lens or a spectacle lens blank in a positionally oriented manner and being insertable into the first and second insert receptacles in such a way that the geometrical centers of the spectacle lenses or spectacle lens blanks received as intended by the first pair of identical inserts are arranged at a first distance from one another. After that, the spectacle lenses or spectacle lens blanks are inserted into the spectacle lens receptacles of the inserts.

After this procedure, the transport container system is ready to provide transport to a machining station. At the machining station, the spectacle lenses or spectacle lens blanks are removed from the spectacle lens receptacles and machined in the machining station. After removal from the base container, i.e. for example during or after the machining of the spectacle lens blanks in the machining station, the base container is loaded with a second pair of identical inserts for the first and second insert receptacles instead of the first pair of identical inserts. The inserts have in each case a spectacle lens receptacle for receiving a spectacle lens or a spectacle lens blank in a positionally oriented manner and are insertable into the first and second insert receptacles in such a way that the geometrical centers of the spectacle lenses or spectacle lens blanks received as intended by the second pair of identical inserts are arranged at a second distance from one another, differing from the first distance (or else possibly at the same first distance). After that, the spectacle lenses or spectacle lens blanks are inserted into the spectacle lens receptacles of the inserts and the base container is subsequently transported further.

During each of the method steps specified above, a first adapter container may be releasably connected to the base container. This adapter container can then be used, for example, for carrying along at the same time tools for the machining station.

During each of the method steps specified above, a second adapter container may also be releasably connected to the first adapter container. This allows, for example, a spectacle frame to be taken along at the same time.

BRIEF DESCRIPTION OF THE DRAWINGS

The invention will now be described with reference to the drawings wherein.

DESCRIPTION OF THE PREFERRED EMBODIMENTS OF THE INVENTION

Figure 5:
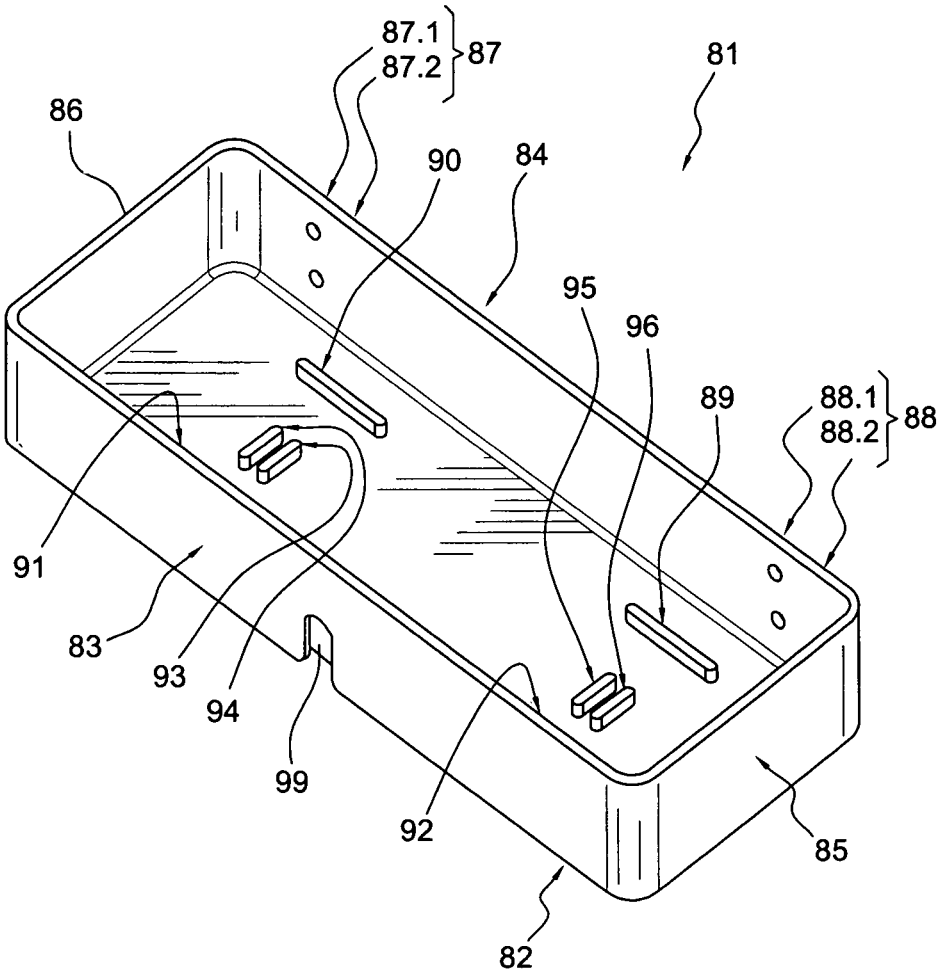
FIG. 5 shows a variant of an adapter container according to the invention, which can be releasably connected to the base container as shown in FIG. 1 and is intended and suitable for receiving a polishing tool for base lens production.
Figure 6:
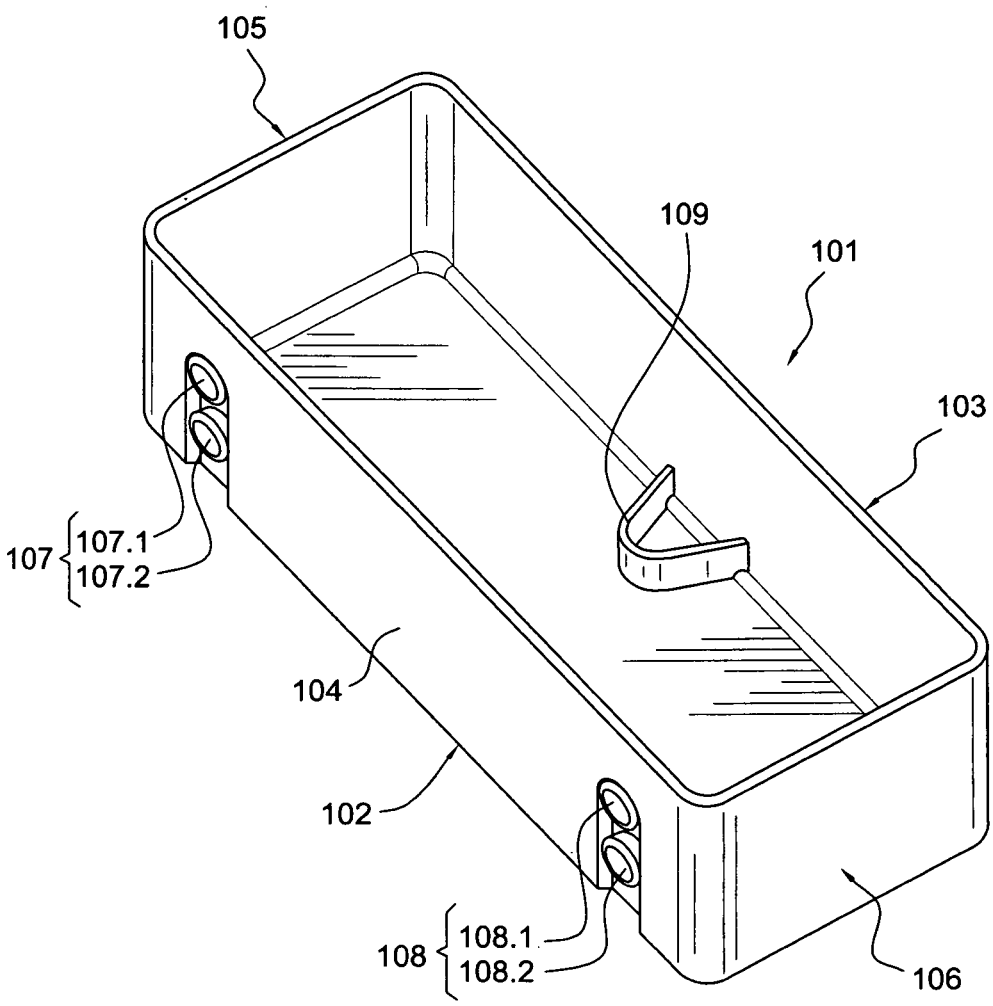
FIG. 6 shows a variant of an adapter container according to the invention, which can be releasably connected to the base container as shown in FIG. 1 or to the adapter container as shown in FIG. 5 and is intended and suitable for receiving a spectacle frame or a spectacle case during the truing process.
Figure 7:
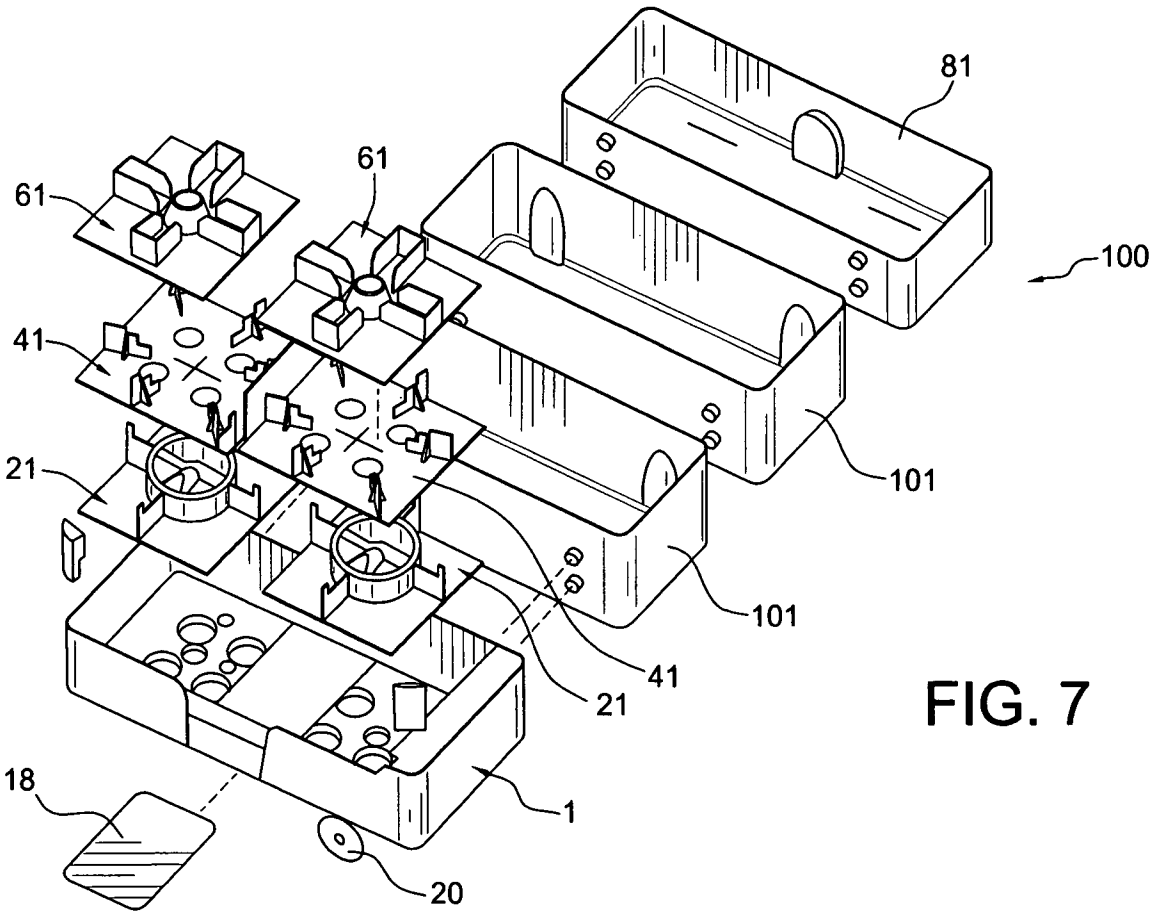
FIG. 7 shows a universal transport container system for spectacle lenses and/or spectacle lens blanks comprising a base container with inserts for receiving spectacle lenses and/or spectacle lens blanks during base lens production, finishing and truing as well as with adapter containers that can be releasably connected to the base container for receiving a spectacle frame, a spectacle case and a polishing tool.

FIGS. 1 to 6 show individual components of a transport container system 100 according to the invention that is shown in FIG. 7.

Figure 1:
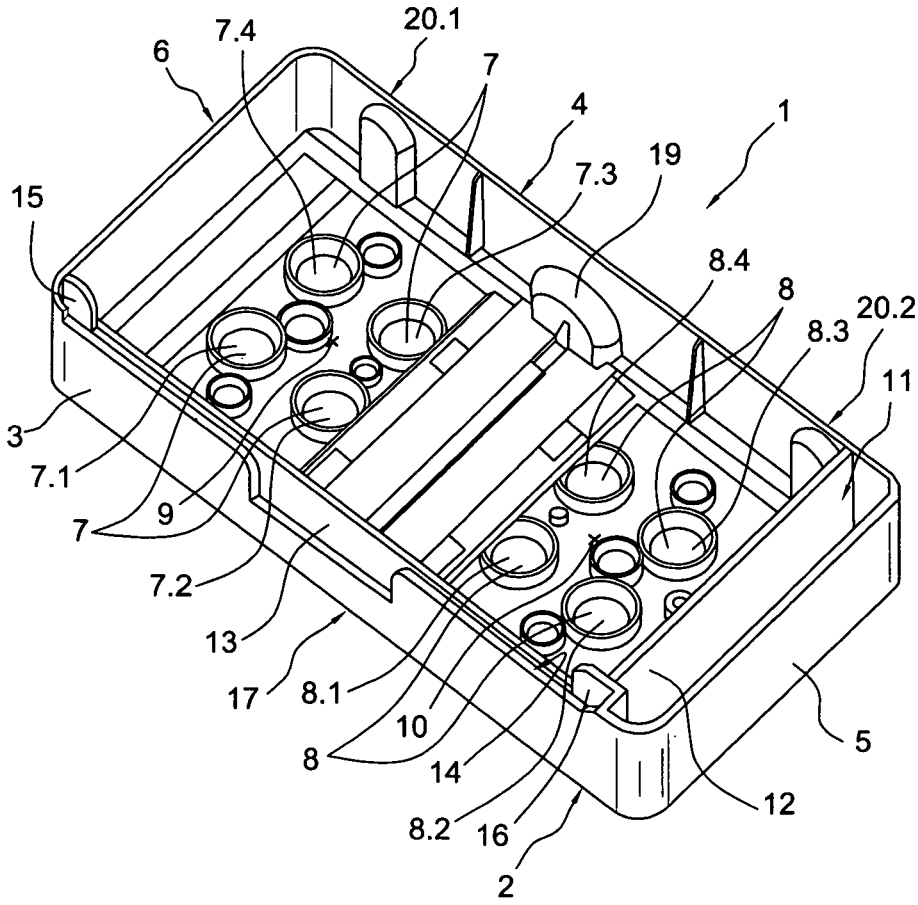
FIG. 1 shows an exemplary embodiment of a base container of a transport container system according to the invention.

FIG. 1 shows a base container 1 according to the invention of the transport container system 100 in a perspective representation. The base container 1 has a shoebox-like basic shape with a bottom plate 2 and four side plates (3, 4, 5, 6) of 58 mm in height. The bottom plate 2 of a rectangular cross section with edge lengths of 250 mm and 125 mm has two receptacles (7, 8), which are formed by four equally spaced circular openings (7.1, 7.2, 7.3, 7.4; 8.1, 8.2, 8.3, 8.4) and are intended and designed for receiving corresponding inserts. The geometrical centers (9, 10) of the openings (7.1, 7.2, 7.3, 7.4; 8.1, 8.2, 8.3, 8.4) arranged at the corners of an imaginary square are arranged at a distance of 130 mm.

Arranged at a distance of 2 cm from the end side plate 5 there is a web 12, which together with said side plate forms a pocket 11, for example for inserting a packaging box. Arranged at a distance of 5 mm from the longitudinal side plate 3, there is a web 13, which together with said side plate forms a pocket. The pocket may be used, for example, for inserting a prescription.

Altogether, the receiving volume of the base container 1 is chosen such that there is space for precisely two inserts for spectacle lens blanks and the associated prescription, but no further tools or accessories such as a spectacle frame and case. Currently used spectacle lens blanks have diameters of between 65 mm and 85 mm.

The base container 1 has on the opening side projections (15, 16), which can be inserted into corresponding complementary depressions (not visible in the representation as shown in FIG. 1) in the underside of a further base container 1 of the same configuration, and consequently allow positionally oriented stacking of a number of base containers 1 of the type described above.

Figure 8:
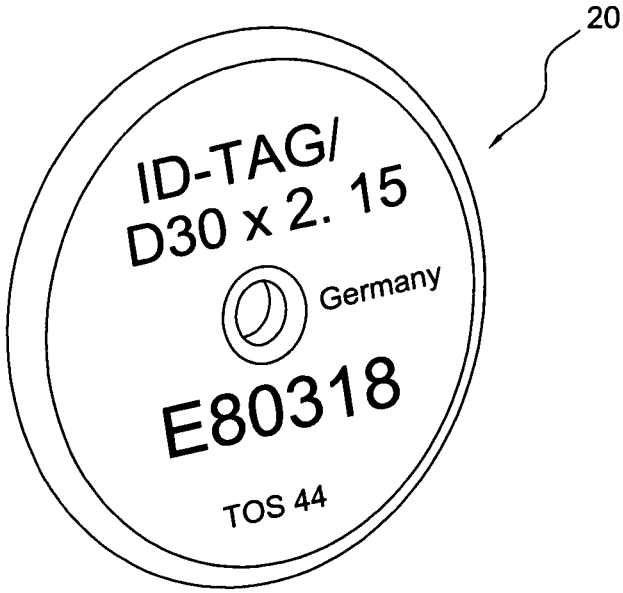
FIG. 8 shows an identification transponder (ID tag) that can be inserted into a corresponding receptacle of the base container or an adapter.
Figure 9:
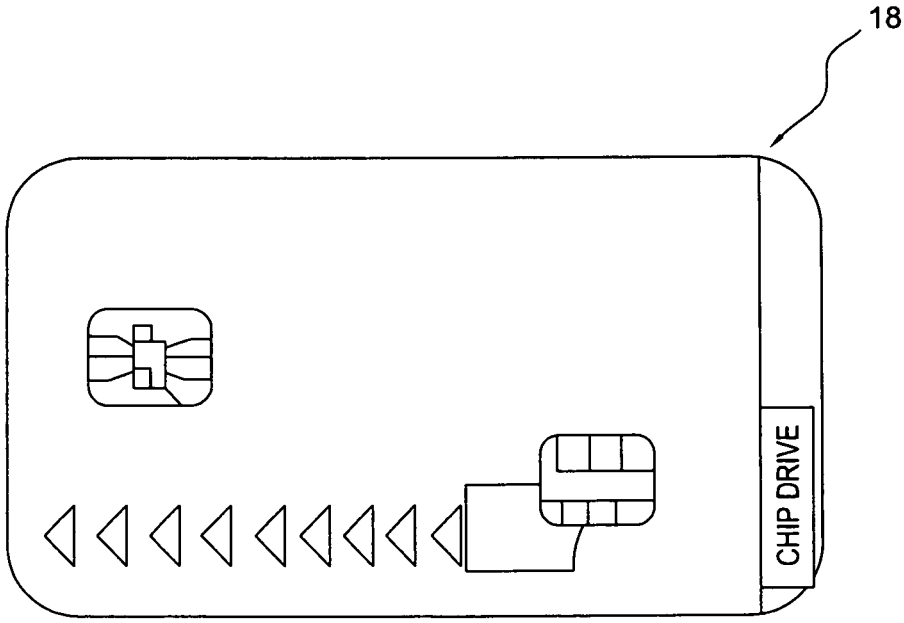
FIG. 9 shows an ID chip card that can be inserted into a corresponding receptacle of the base container or an adapter; and, FIGS. 10A and 10B show a flow diagram of a method for transporting spectacle lenses and/or spectacle lens blanks by means of conventional transport containers (flow line A) and three method variants using a transport container system according to the invention, as represented for example in FIG. 7 (flow lines B to D).

The side plate 4 has in the middle a hollow profile 19, into which a transponder 20 in the form of a coin represented in FIG. 8 can be inserted. The bottom plate 2 is formed in the middle in the manner of a hollow profile (hollow profile with the reference numeral 17), which makes it possible to receive a transponder 18 in the form of a card of the type represented in FIG. 9.

Figure 2:
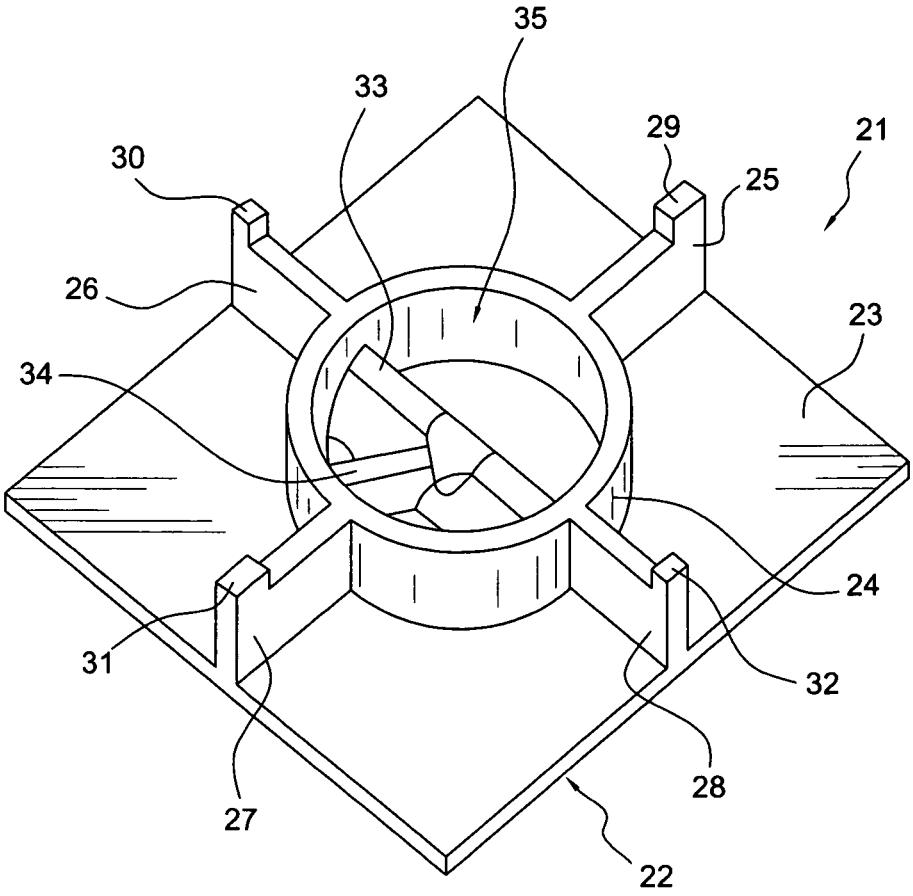
FIG. 2 shows an insert for the base container as shown in FIG. 1, suitable for receiving a semifinished product during base lens production.

FIG. 2 shows an insert 21 for the base container 1 as shown in FIG. 1 that is suitable for receiving a semifinished product during base lens production. The insert 21 has a bottom plate 23 with a square end face. It has on the underside 22 (not visible in FIG. 2), spaced apart in a way complementing the openings (7.1, 7.2, 7.3, 7.4 and 8.1, 8.2, 8.3, 8.4), cylindrical pins (not visible in FIG. 2), which allow a captive but releasable connection between the insert 21 and the base container 1.

On its end face, the insert 21 is provided with a tubular extension 24 with four radially protruding webs (25, 26, 27, 28), which are arranged at right angles in relation to one another and end in lugs (29, 30, 31, 32) protruding in the axial direction. Arranged radially inside the extension 24 are two webs (33, 34). These webs serve for receiving a standardized block piece. The web 34 sets the clear orientation of a right-hand and/or left-hand spectacle lens in the blocked state. The central lock 36 serves for the defined ejection of a blocked spectacle lens from below. The tubular extension 24 with the four radially protruding webs (25, 26, 27, 28) arranged at right angles in relation to one another with their lugs (29, 30, 31, 32) protruding in the axial direction as well as the two webs (33, 34) therefore form a receptacle 35 for receiving a semifinished spectacle lens.

If two identically formed inserts 21 are inserted with their cylindrical pins, arranged on the underside of the insert, into the openings (7.1, 7.2, 7.3, 7.4 and 8.1, 8.2, 8.3, 8.4), respectively, provided for them in the bottom plate 23 of the base container 1, the geometrical centers of the inserts 21 are at a distance of 130 mm from one another, i.e. what is known as the dimension between axes is 130 mm.

Figure 3:
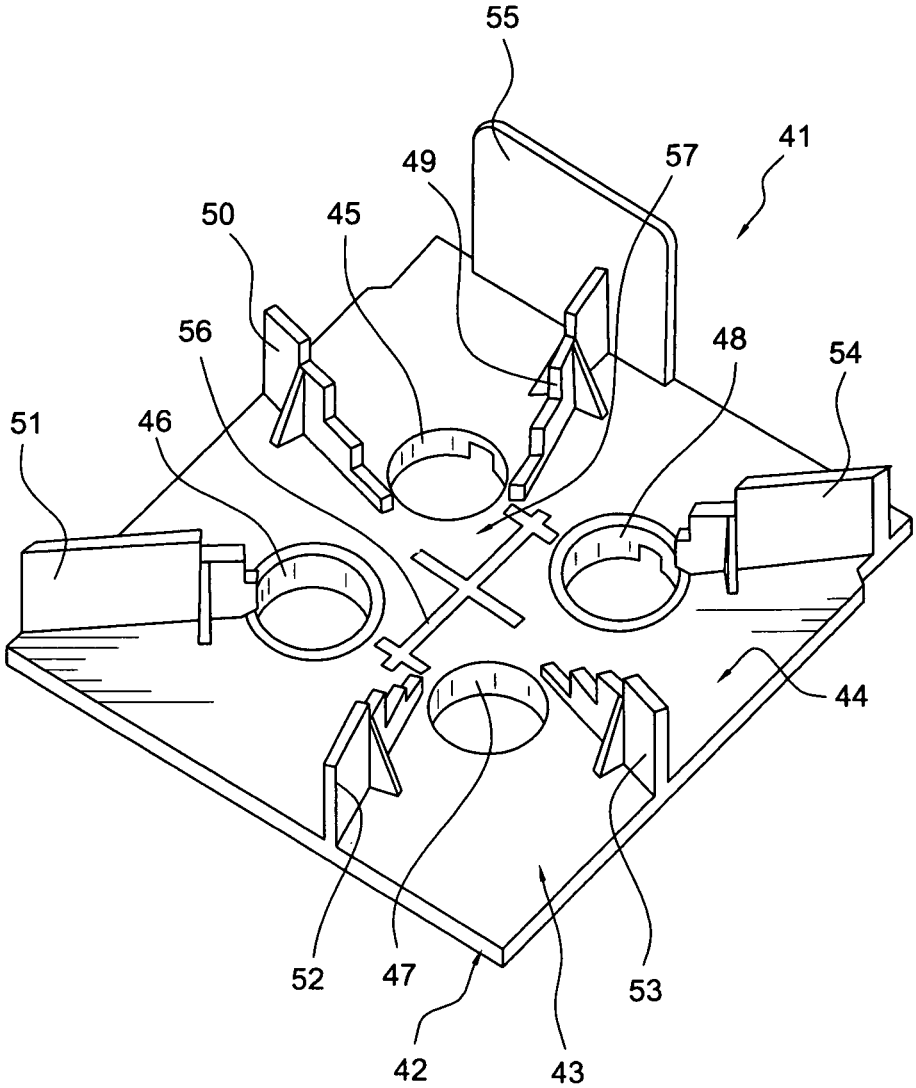
FIG. 3 shows an insert according to the invention for the base container as shown in FIG. 1, suitable for receiving a base lens and intended for holding it during transport in various finishing steps.

FIG. 3 shows an insert 41 for the base container 1 as shown in FIG. 1 that is suitable for receiving a base product during finishing. The insert 41 has a bottom plate 43 with a square end face 44. The insert 41 has on the underside 42 (not visible in FIG. 3), spaced apart in a way complementing the openings (7.1, 7.2, 7.3, 7.4 and 8.1, 8.2, 8.3, 8.4), hollow-cylindrical pins (45, 46, 47, 48), which ensure a captive but releasable connection between the insert 41 and the base container 1.

On its face, the insert 41 has six webs (49, 50, 51, 52, 53, 54), which are arranged at the same angle in relation to one another and protrude from the end face 44 in the axial direction, rising up from radially inside to radially outside in the manner of steps. Furthermore, there is a web 55 protruding from the end face 44. Incorporated in the central region of the end face 44 is a geometrical structure 56 in the form of three lines intersecting a line at right angles. The six webs (49, 50, 51, 52, 53, 54) arranged at the same angle in relation to one another as well as the web 55 together form a receptacle 57 for receiving a base spectacle lens. The arrangement is designed such that both 3-finger grippers and 4-finger grippers can load and remove the lenses. The web 55 prevents a spectacle lens from slipping over onto the other half of the container during transport and additionally fixes the packaged spectacle lenses in their bags.

If two identically formed inserts 41 are inserted with their cylindrical pins, arranged on the underside of the insert, into the openings (7.1, 7.2, 7.3, 7.4 and 8.1, 8.2, 8.3, 8.4), respectively, provided for them in the bottom plate 23 of the base container 1, the geometrical centers of the inserts 41 are at a distance of 130 mm from one another.

Figure 4:
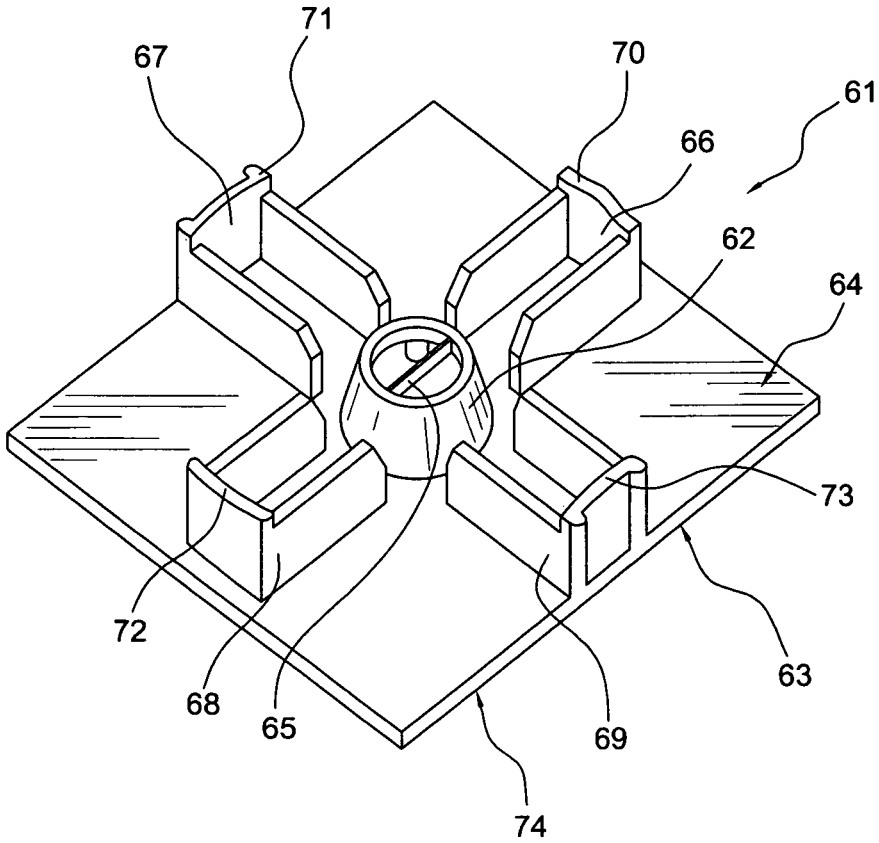
FIG. 4 shows an insert suitable for receiving a finished product and holding it during transport during truing.

FIG. 4 shows an insert 61 for the base container 1 as shown in FIG. 1 for receiving a finished product during the truing process. The insert 61 has a base plate 63 with a square end face 64. The base plate 63 has on the underside 74 (not visible in FIG. 4), spaced apart in a way complementing the openings (7.1, 7.2, 7.3, 7.4 and 8.1, 8.2, 8.3, 8.4), cylindrical pins (not visible in FIG. 4), which allow a captive but releasable connection between the insert 61 and the base container 1.

On its end face 64, the insert 61 is provided with a conically tapered tubular extension 62 with an inner web 65. Arranged around the extension 62 are four radially protruding slotted webs (66, 67, 68, 69), which are arranged at right angles in relation to one another and end in lugs (70, 71, 72, 73) protruding in the axial direction.

These fix not yet blocked spectacle lenses before truing and after unblocking, for example before fitting.

If two identically formed inserts 61 are inserted with their cylindrical pins, arranged on the underside of the insert, into the openings (7.1, 7.2, 7.3, 7.4 and 8.1, 8.2, 8.3, 8.4), respectively, provided for them in the bottom plate 23 of the base container 1, the dimension between axes is 112.5 mm.

FIG. 5 shows an adapter container 81 according to the invention in a perspective representation. This represents an optional component part of the transport container system 100 as shown in FIG. 7. Like the base container 1, the adapter container 81, having a bottom plate 82 and four side plates (83, 84, 85, 86), has a shoebox-like basic shape with edge lengths of a length=250 mm, a width=95 mm and a height=58 mm. The side plate 84 has two connecting elements (87, 88), which are formed by two outwardly protruding cylindrical studs (87.1, 87.2; 88.1, 88.2), which are arranged at equal distances and are intended and designed for engaging in a releasable and plug-in connecting manner in complementarily formed slit-like openings (20.1, 20.2) of base and adapter containers (1, 81). The side plate 83 is slit in the middle, forming a pocket 99 suitable for receiving an ID tag 20.

On the bottom plate 82 there are four webs (89, 90, 91, 92), running along the side plates (83, 84), and between said webs in turn four webs (93, 94, 95, 96), arranged in pairs and running parallel to the side plates (85, 86). The arrangement of the webs (89, 90, 91, 92; 93, 94, 95, 96) is chosen such that a polishing tool (not shown) can be inserted in a positionally oriented manner. Consequently, the polishing tool can be removed in an automated manner and, in the case of manual handling, is fixed in order to avoid unnecessary weight displacement.

FIG. 6 shows a further adapter container 101 according to the invention in a perspective representation. Like the base container 1 and the adapter container 81 intended for receiving a polishing tool, the adapter container 101, having a bottom plate 102 and four side plates (103, 104, 105, 106), has a shoebox-like basic shape with edge lengths of a length=250 mm, a width=95 mm and a height=58 mm. The side plate 104 has two connecting elements (107, 108), which are formed by two outwardly protruding cylindrical studs (107.1, 107.2; 108.1, 108.2), which are arranged at equal distances and are intended and designed for engaging in a releasable manner in complementarily formed slit-like openings (20.1, 20.2) of base and adapter containers (1, 81), representing a plug-in connection. The side plate 103 has in the middle a pocket (not shown) suitable for receiving an ID tag 20.

Provided on the inner side of the side plate 103 is a loop 109 for receiving a spectacle frame (not shown). Screw fittings and nose pads for the particular customer order can be taken along at the same time within the loop compartment, without the small screws/nuts being able to move around randomly in the container. The adapter container 101 is chosen to be large enough that it can also receive a spectacle case (likewise not shown).

To sum up, FIG. 7 shows an exemplary embodiment of a universal transport container system 100 for spectacle lenses and/or spectacle lens blanks comprising the individual components described above, that is: the base container 1, with in each case a pair of inserts (21, 41, 61) for receiving spectacle lenses (not shown) and/or spectacle lens blanks (not shown) during base lens production, finishing and truing, as well as with adapter containers (81, 101) that can be releasably connected to the base container 1 for receiving a spectacle frame (not shown), a spectacle case (not shown) and a polishing tool (not shown).

Figure 10A:
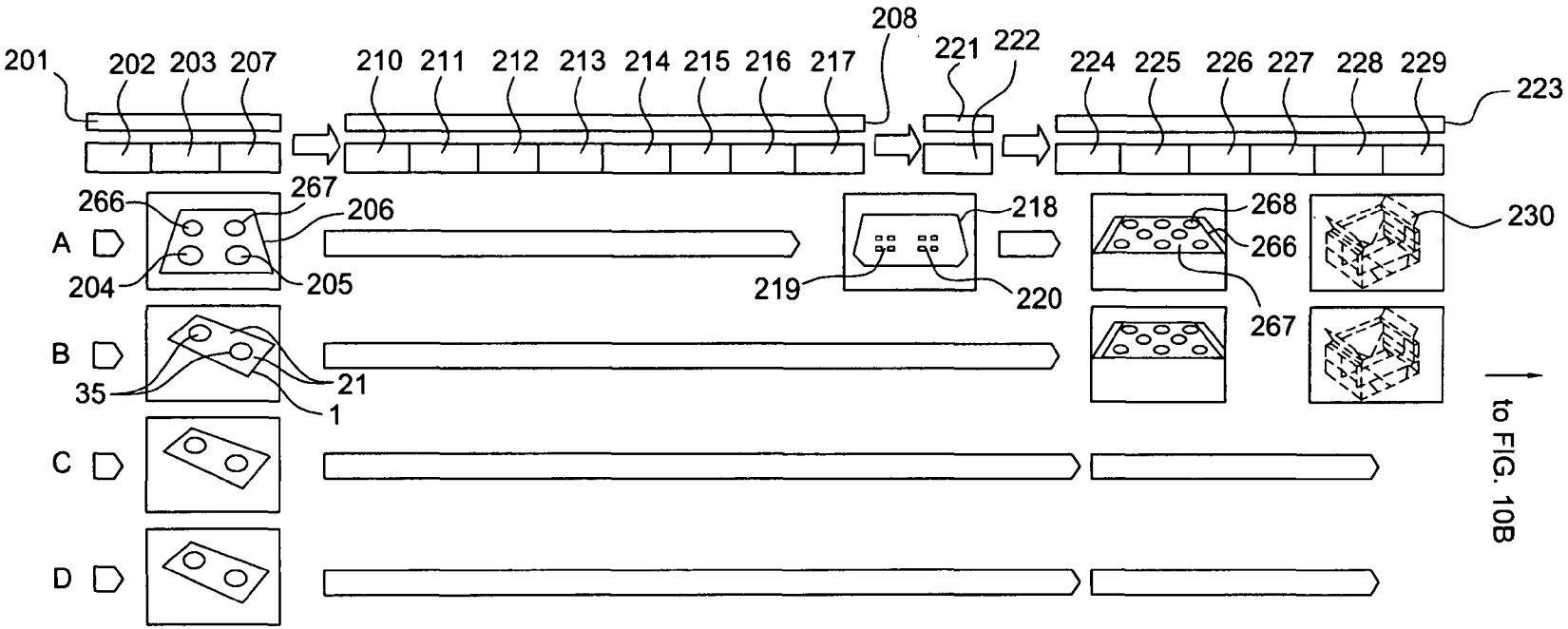
Figure 10B:
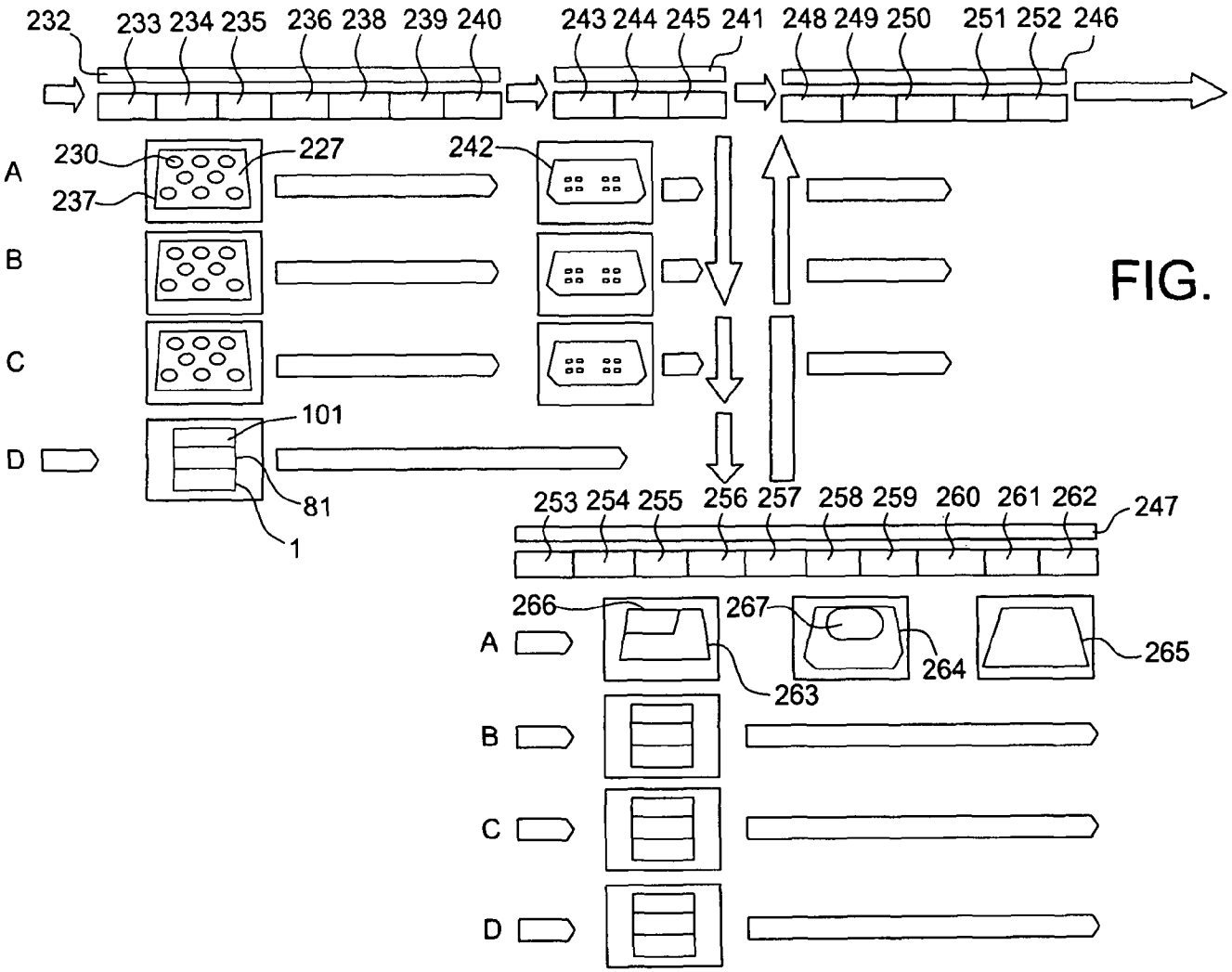

FIGS. 10A and 10B show a flow diagram of a method for transporting spectacle lenses and/or spectacle lens blanks. Shown for comparison in the representation is transport by means of conventional transport containers (flow line A) and transport using a transport container system according to the invention, as represented for example in FIG. 7 (three variants, flow lines B to D).

A. Transport of spectacle lens blanks/spectacle lenses during the production of the spectacle lenses from semifinished products with a conventional transport container system according to the prior art.

For natural types of glass, spectacle lens production begins with a blank, the surfaces of which are machined in such a way that the lens has the desired refractive power distribution. Production from products known as semifinished has in the meantime become established. In production theory, semifinished products is the term used for partially finished preliminary products that are either put into the production company's store for later processing or sent to other companies and made into the final product there.

In the first case, the semifinished products HF are in a store known as a logistical semifinished product or HF store 201. By means of automated grippers, a pair of suitable semifinished products HF are removed from the HF store 201 as a result of a customer order (step 202). The order is prepared (step 203) by the HF pair being deposited in a pair of receptacles (266, 267) of the conventional transport container 206 that are spaced apart with the dimension between axes of 130 mm. After the i point registration (step 207), in which logistical information, such as for example an order or identification number, is transmitted to the production system or matched up, the transport container 206 with the two semifinished spectacle lenses HF is transported to what is known as base lens production 208.

The semifinished product HF has already been finished on one face, usually the front side. In base lens production 208, the prescription face is finished on the basis of the individual prescription data. For this purpose, the semifinished products HF are first individually removed from the transport container 206, provided on the prefabricated side with a protective coating or a protective film (step 210) and then blocked (step 211). The blocked semifinished products HF are then deposited in other receptacles (204, 205) in the transport container 206 and transported further by means of a conveying device to the next machining unit. The receptacles (204, 205) are formed such that the semifinished products HF have a predetermined positional orientation. The blocked semifinished products are individually removed again from the processing unit and clamped onto a spindle of a generator. In this generator, the unmachined side of the spectacle blank HF is given the desired surface contour (step 212). This may include, for example, the process steps of centering, milling with a diamond-corundum cup tool, or centering/milling with a milling tool or electroplated wheel and turning. After that, the blanks machined in this way are placed again in the receptacles (204, 205) of the transport container in a positionally correct and right/left-correct manner and possibly transported further to the fine-grinding or lapping station and subsequently to the polishing station. Before reaching the polishing station, polishing tool loading is first performed with polishing tools of aluminum or plastic. The polishing tools are thereby deposited in the receptacles (266, 267) in the container 206 in a positionally and right/left-correct manner. At the polishing station, the tools and spectacle lenses are individually removed again manually or by machine. After that, the previously machined surface is in each case polished (step 213). For free-form designs, the soft polishing tools (polishing pads and foams) are stored in the polishing machines. It is not necessary, but is possible in principle, for the soft polishing tools to be transported along at the same time. After that, the lenses are placed again in the transport container 206 and transported to the quality-control station, removed there and the respective polished surface is then measured (step 214). After the measuring, the still blocked lenses are deposited again in the transport container 206 and transported to the marking station. Once they have arrived there, they are individually removed, provided with signature marks (step 215) and deposited again in the transport container 206. After the transport to the melting installation and the melting away 216 of the block piece that is performed there, the lenses referred to as base lenses are deposited in turn in the transport container 206 and transported further to a washing device, where these base lenses are subjected to a cleaning procedure 217.

After completion and removal of the base lens from the container, the container 206 with the polishing tools goes away to be stored.

Between process steps 216 and 217 there is typically a change of container. Either directly before 216 or between 216 and 217 or after 217. As shown in FIGS. 10A and 10B, the base lenses may, for example, go into a different transport container 218 with a shape differing from the transport container 206 described above. This other transport container 218 has in turn receptacles (219, 220) for the (base lens) blanks, which are arranged with a dimension between axes of 112.5 mm. The use of another transport container 218 has the purpose of preventing contamination by dirt particles that enter the container used during the base lens production from being caused when the contaminated blanks are transferred between the individual production steps.

The washed base lenses deposited in the transport container 218 are either passed on directly to a hard coating process 223 or first transported to a tinting station 221, where they are tinted as requested by the customer (method step 222).

The hard coating process 223 comprises first removing the possibly tinted base lenses from the other transport container 218, order picking 224 and subsequent fixing in spring-loaded immersers or adhesive-bonding holders (step 225). This is performed in batch sizes of 6, 10, 20 or 40 individual lenses. For this purpose, they may be deposited in the lens receptacles 268 of a carrier 267 that has eight lens receptacles 268 and is in turn inserted into a box-like transport container 266. The lens receptacles 268 are formed such that the lenses are supported without any contact with the optical faces, i.e. the front and rear faces. The individual lenses are subsequently washed within this container 266 (step 226) and cooled (step 227) in order to have as little temperature difference as possible from the hard coating. To apply the hard coating, the lenses are transferred into a special holder 230 and immersed in an immersion bath (step 228). In these containers, the lenses may either be passed on to a toughening process 229 without further transfer or be passed on to the process 229 by being transferred to a toughening container that is not represented.

The hard coating procedure 223 is followed by an antireflection coating 232. This procedure 232 comprises the process steps of order picking 233, washing 234, drying 235 and inserting 236 the spectacle lenses in hemispherical holders. Between these process steps (233, 234, 235, 236) there is always transport in a further container 237, into which the carrier 267, in the receptacles 268 of which the lenses have in the meantime been inserted.

The hemispherical holders with the lenses are subsequently fitted in a vacuum coating installation, where a reflection-reducing coating is vapor-deposited (step 238). After that, the hemispherical holders with the antireflection-coated lenses are removed from the vapor-depositing installation (step 239) and the lenses are placed again in the carrier 267, where they are dried (step 240).

The antireflection coating process 232 is followed in turn by a control 241 with the method steps of measuring 243, marking 244 and packaging 245, during which the pair of lenses of a spectacle are inserted into a container 242 of the type described above (container 218) and transported.

After completion of the process step comprising control 241, the preparation for dispatching the spectacle lenses to the customer (process step 246) is either performed immediately or there is an intermediate step involving a truing process 247, i.e. adaptation of the outer contour of the spectacle lens to the lens frame.

In the first case, the pair of spectacle lenses is transported further in the transport container 242. In this case, this transport container 242 is assigned to a store or buffer 248 until the delivery documents, invoice and dispatch bag have been prepared. The pair of spectacle lenses is packed together with the delivery note 249 and the prescription 250 (step 251) and, still in the transport container 242, distributed for final transport to the customer (step 252).

For the case where the truing operation 247 is also performed within the production company, the spectacle lenses and the spectacle frame must be brought together. Therefore, according to the prior art, (at least) one additional transport container is provided for receiving the spectacle lenses and the spectacle frame during the transfer from one production step to the next. During the truing operation 247, according to the company's own state of the art, different transport containers (263, 264, 265) are used. First a prescription is produced for the pair of spectacle lenses (step 253) and is likewise enclosed in the transport container (263, 264, 265). After that, the outer contour is detected by means of sensing the frame, template or specimen lens (tracing 254) and/or the data record for the outer contour is already available in an electronic form. Marking out 255 of the axis or the reference signatures and subsequent blocking 256 are performed, in order to receive the lens in the truing machine/device in a positionally oriented manner. In the blocked state, the spectacle lenses are trued (step 257) and polished (step 258). In the case of frameless spectacles, holes are drilled (step 259), in order to allow the spectacle lenses to be fixed to the spectacle frame. The trued spectacle lenses are fitted on the spectacle frame with or without holes (step 260). A final control 261 and packing 262 are performed.

The transport containers (263, 264, 265) serve for receiving the spectacle lenses, a spectacle case (266, 267) and the prescriptions 253. A transport container 265 with receptacles for the lenses of a pair of spectacle lenses with a dimension between axes of 112.5 cm serves for receiving the spectacle lenses.

The logistics and dispatch of the finished spectacles are performed in analogy with the logistics and dispatch of an individual spectacle lens or a pair of spectacle lenses (cf. procedure 246).

It is evident from the above description that, according to the company's internal state of the art, a large number of different transport containers can be used in a process sequence up to the finished spectacle lens or the finished spectacles. The transport container system 100 according to the invention allows the number of different transport containers to be reduced, as shown below.

B-D. Transport of spectacle lens blanks/spectacle lenses during production of the spectacle lenses from semifinished products with the transport container system 100 according to FIG. 7.

Proceeding once again from production based on semifinished products, the transport of the blank, spectacle lenses and any additional components may be performed in the ways described below (method sequences B, C and D).

At first, the semifinished products HF are in the HF store 201. By means of automated grippers, a pair of suitable semifinished products HF are removed from the HF store 201 as a result of a customer request (step 202) and inserted into the receptacles 35 of two identical inserts 21, which in turn are themselves inserted into the corresponding insert receptacles (7, 8) in the base container 1. The inserts 21 are arranged in a predetermined position in relation to one another as a result of their rear sides being geometrically formed to complement the insert receptacles (7, 8). This position is chosen such that the axes of the receptacles 35, and consequently the semifinished products inserted into these receptacles 35, are arranged spaced apart from one another with a dimension between axes of 130 cm (step 203). If required, an adapter container 81 of the type described above, releasably connected to the base container 1, can be taken along at the same time for receiving polishing tools.

After the i point registration (step 207), in which the logistical information, for example an order or identification number, is transmitted to the production system or matched up, the semifinished products are transported while in the same base container 1 to base lens production 208. During the sorting of the semifinished products, the ID number of the RFID tag in the production system is assigned to the order number.

The semifinished products HF are individually removed from the base container 1, provided on the prefabricated side with a protective coating or protective film (step 210) and then blocked (step 211). The blocked semifinished products HF are then deposited again in the receptacles 35 provided for them in the base container 1 and transported further to the generator. There, the blocked semifinished products HF are individually removed again and clamped onto a spindle of the generator. In this generator, the unmachined side of the spectacle blank HF is given the desired surface contour (step 212). After that, the blanks machined in this way are placed again in the base container 1, and transported further to the polishing station. If the process so provides, the adapter container 81 connected to the base container 1 is loaded with polishing tools before reaching the polishing station (not shown). At the polishing station, the polishing tools, if present, and the semifinished products are removed. The previously machined surface is in each case polished there (step 213). Then, the lenses are placed again in the way described above in the receptacles 35 of the inserts 21 located in the base container 1 and transported to the quality-control station, removed there and the respective polished surface is then measured (step 214). After the measuring, the still blocked lenses are deposited again in an identical way and transported to the marking station. Once they have arrived there, they are individually removed again, provided with signature marks (step 215) and deposited again in the base container 1. After the transport to the melting installation and the melting away 216 of the block piece that is performed there, the base lenses are deposited in turn in the unchanged base container 1 with the inserts 21. In this base container 1, the base lenses are transported to the washing device, where they are subjected to a cleaning procedure 217.

After the washing 217, the base lenses are returned to the base container 1, which however is now loaded with the inserts 41. These inserts may be arranged in relation to one another with the same or a different dimension between axes. The washed base lenses deposited in the receptacles 57 of the inserts 41 in the base container 1 are either passed on directly to a hard coating process 223 or first tinted as requested by the customer (method step 222). The actual tinting process requires a special container, which is not discussed any further here. Further transport to the next finishing process step is once again performed in the base container 1 with the inserts 41.

To transport the base lenses between the individual process steps (224, 225, 226, 227, 228, 229) during the hard coating process 223, they may again—as known from the company's internal state of the art—be deposited in the lens receptacles 268 of the carrier 267, which is then in turn inserted into the box-like transport container 266 and then into the holder 230 (cf. process sequence B). However, it is also possible to insert the unfinished spectacle lenses in each case again into the receptacles 57 of the base container 1 loaded with the inserts 41 and transport them in this base container 1 between the individual process steps (224, 225, 226, 227, 228, 229).

If corresponding connecting means are provided on the base container 1 (which is not shown in the case of the example shown in FIG. 1), a number of identical base containers 1 can be put together to form a larger unit. If required, a number of identical units can in turn also be stacked.

During the antireflection-coating process 232, following the hard coating procedure 223, with the process steps of order picking 233, washing 234, drying 235 and inserting 236 spectacle lenses into hemispherical holders 230, fitting the hemispherical holders in the vacuum coating installation with subsequent coating 238, removal of the hemispherical holders from the vapor-depositing installation and inserting the lenses into the carrier 227 (step 239) as well as subsequent drying 240, transport such as that described above may be performed (process sequences B and C). However, instead of the transport container 267, it is also possible to use the base container 1 with the inserts 41 or 61 described above and, if required, flange-mount adapter containers (81, 101) onto said base container (process sequence D).

During the control 241, following the antireflection-coating process 232 and comprising the method steps of measuring 243, marking 244 and packaging 245, the respective pair of lenses of a spectacle are inserted again into the base container 1 with the receptacles 21 and transported. If process sequence B or C is followed, a change of the transport container is required, if process sequence D is followed, a change is unnecessary.

After completion of the process step comprising control 241, the preparation for dispatching the spectacle lenses to the customer (process step 246) may be performed immediately. The transport container is not usually changed for the transport of the spectacle lenses (process sequences B to D). It is therefore sufficient to use the base container 1 (process sequences B and C). In the case of process sequence D, instead of using the base container 1 alone (which is possible but not shown in FIGS. 10A and 10B), the complete container assembly comprising the base container 1 and the two adapter containers (81, 101) may also be used for transport.

Many optometrists do not themselves true the lenses in the corresponding spectacle frames. The truing process 247 is then carried out at the production company itself. In this case, it is necessary to assign the spectacle lenses that are in the base container 1 a spectacle frame and possibly a spectacle case. The base container 1 is therefore combined with an adapter container 101 for a spectacle frame and an adapter container 101 for a spectacle case, forming the composite container. The adapter container 101 for the spectacle case and the adapter container 101 for the spectacle frame may in this case be of an identical form, to be specific such as for example that represented in FIG. 6.

For the above reasons, it is necessary that the receptacles for the lenses of a pair of spectacle lenses have a dimension between axes of 112.5 cm. Then the inserts 61 as shown in FIG. 4 are used.

The logistics and dispatch of the finished spectacles are performed once again in analogy with the logistics and dispatch of an individual spectacle lens or a pair of spectacle lenses (cf. procedure 246 for the process sequences B-D).

It is understood that the foregoing description is that of the preferred embodiments of the invention and that various changes and modifications may be made thereto without departing from the spirit and scope of the invention as defined in the appended claims.

What is claimed is:

1. A transport container system for spectacle lenses and/or spectacle lens blanks comprising:

first spectacle lenses or spectacle lens blanks having respective first geometric centers;

second spectacle lenses or spectacle lens blanks having respective second geometric centers;

a first pair of identical first and second inserts having respective spectacle lens receptacles configured for receiving in a positionally oriented manner respective ones of said first spectacle lenses or spectacle lens blanks;

a base container having a first insert receptacle configured for receiving said first insert in a positionally oriented and releasably captive manner and having a second insert receptacle configured for receiving said second insert in a positionally oriented releasably captive manner;

said first and second inserts being configured to be insertable into said first and second insert receptacles of said base container in such a manner that, when said first spectacle lenses or said spectacle lens blanks are received in said inserts, said first geometrical centers are at a first distance from each other;

a second pair of identical third and fourth inserts configured for said first and second insert receptacles;

said second pair of inserts being different from said first pair of inserts and having respective spectacle lens receptacles configured for receiving in a positionally oriented manner respective ones of said second spectacle lenses or spectacle lens blanks;

said second pair of inserts being configured to be insertable into said first and second insert receptacles of said base container so as to be releasably captively held therein and in such a manner that, when said second spectacle lenses or said spectacle lens blanks are received in said second pair of inserts, said second geometrical centers are at a second distance from each other; and, said second distance being different from said first distance.

2. The transport container system of claim 1, further comprising a third insert receptacle configured for receiving said second insert in a positionally oriented manner; wherein:

said first, second and third insert receptacles have respective geometric centers;

said geometric center of said first insert receptacle has a third distance from said geometric center of said third insert receptacle;

said geometric center of said first insert receptacle has a fourth distance from said geometric center of said second insert receptacle; and, said third distance is different from said fourth distance.

3. The transport container system of claim 2, wherein:

said second pair of identical inserts are configured for said first and second insert receptacles;

said second pair of inserts each have a spectacle lens receptacle configured for receiving in a positionally oriented manner a spectacle lens or spectacle lens blank having a geometric center;

said second pair of inserts is configured to be insertable into said first and second insert receptacles in such a manner that when said spectacle lenses or said spectacle lens blanks are received in said inserts said geometrical centers have a fifth distance from each other; and, said fifth distance is different from said first distance.

4. The transport container system of claim 1, wherein:

said insert receptacles and said inserts of one of said first pair and said second pair are configured complementary to each other in such a manner that said inserts have a predetermined orientation to each other when inserted into said insert receptacles.

5. The transport container system of claim 1, wherein said first pair of inserts are configured for receiving semifinished spectacle lenses.

6. The transport container system of claim 1, wherein said first or said second pair of inserts are configured for receiving spectacle lenses during finishing.

7. The transport container system of claim 2, further comprising:

a third pair of identical inserts configured for said first insert receptacle and for one of said second and said third insert receptacles; and, said third pair of inserts being configured for receiving spectacle lenses during truing.

8. The transport container system of claim 1, further comprising a first adapter container configured to detachably connect to said base container.

9. The transport container system of claim 8, wherein said first adapter container has a receptacle configured for receiving a spectacle frame.

10. The transport container system of claim 8, further comprising a second adapter container configured to detachably connect to at least one of said base container and said first adapter container.

11. The transport container system of claim 10, wherein said second adapter container has a receptacle configured for receiving a spectacle case.

12. The transport container system of claim 10, further comprising a third adapter container configured to detachably connect to at least one of said first adapter container, said second adapter container and said base container.

13. The transport container system of claim 12, wherein said third adapter container has a receptacle configured for receiving a polishing tool.

14. The transport container system of claim 8, wherein said base container and said first adapter container are configured geometrically identically but also distinguishably from each other.

15. The transport container system of claim 10, wherein at least two of said first adapter container, said second adapter container and said base container are configured geometrically identically but also distinguishably from each other.

16. The transport container system of claim 12, wherein at least two of said first adapter container, said second adapter container, said third adapter container and said base container are configured geometrically identically but also distinguishably from each other.

17. A method for transporting spectacle lenses or spectacle lens blanks with a transport container system, said method comprising the steps of:

providing a base container having a first insert receptacle for the position oriented receiving of a first insert for receiving a spectacle lens or a spectacle lens blank and having a second insert receptacle for the position oriented receiving of a second insert for receiving a spectacle lens or a spectacle lens blank;

providing the base container with a first pair of identical inserts configured for the first and second insert receptacles and each insert having a spectacle lens receptacle for position oriented receiving of a spectacle lens or a spectacle lens blank;

the inserts also being configured to be received by the first and second insert receptacles in such a manner that the geometric centers of spectacle lenses or spectacle lens blanks received in the first pair of inserts are arranged at a first distance to each other;

inserting spectacle lenses or spectacle lens blanks into the spectacle lens receptacle of the inserts;

transporting the base container to a workstation;

removing the spectacle lenses or spectacle lens blanks from the spectacle lens receptacles;

processing the spectacle lenses or spectacle lens blanks at the workstation;

providing the base container with a second pair of identical inserts in lieu of the first pair of identical inserts, the second pair of inserts each having a spectacle lens receptacle for position oriented receiving of a spectacle lens or a spectacle lens blank and being configured to be received by the first and second insert receptacles in such a manner that the geometric centers of the spectacle lenses or spectacle lens blanks received in the second pair of inserts are arranged with respect to each other at the same first distance or at a second distance wherein the first and second distances can be different;

inserting the spectacle lenses or spectacle lens blanks into the spectacle lens receptacles of the inserts; and, transporting the base container further.

18. The method of claim 17, wherein a first adapter container is detachably connected to the base container.

19. The method of claim 18, wherein a second adapter container is detachably connected to the first adapter container.

* * * * *